US007093810B2

(12) United States Patent
Recknagel et al.

(10) Patent No.: US 7,093,810 B2
(45) **Date of Patent: *Aug. 22, 2006**

(54) TABLE-MOUNTED BOWLING SCORING UNIT

(75) Inventors: Troy A. Recknagel, Muskegon, MI (US); Barry L. Atwood, Grand Rapids, MI (US)

(73) Assignee: Brunswick Bowling & Billiards Corporation, Muskegon, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/639,848

(22) Filed: Aug. 13, 2003

(65) Prior Publication Data

US 2004/0046093 A1 Mar. 11, 2004

Related U.S. Application Data

(63) Continuation of application No. 09/330,955, filed on Jun. 11, 1999, now Pat. No. 6,619,603.

(51) Int. Cl.
*F16M 11/00* (2006.01)

(52) U.S. Cl. ..... 248/200; 248/917

(58) Field of Classification Search ..... 248/200, 248/918, 346.03, 346.06, 205.1, 220.22, 248/222.51, 224.7, 125.7, 276.1, 118, 298.1, 248/917, 920, 825, 831

See application file for complete search history.

(56) References Cited

U.S. PATENT DOCUMENTS

| | | | | |
|---|---|---|---|---|
| 1,296,060 A | | 3/1919 | Ferguson | 248/118 |
| 1,873,705 A | | 8/1932 | Green | 248/280 |
| 2,452,291 A | | 10/1948 | Catron | 311/33 |
| 2,534,623 A | * | 12/1950 | Pitts et al. | 5/601 |
| 2,570,634 A | | 10/1951 | Bartschy | 311/33 |
| 3,341,266 A | | 9/1967 | Schecter et al. | 312/11 |
| 3,856,251 A | | 12/1974 | Miller | 248/280 |
| 4,092,727 A | | 5/1978 | Warner | 364/900 |
| RE30,471 E | | 1/1981 | Reynolds | 273/54 |
| 4,487,389 A | | 12/1984 | Ziegler | 248/282 |
| 4,494,720 A | | 1/1985 | Gregory et al. | 248/371 |
| 4,515,086 A | | 5/1985 | Kwiecinski et al. | 108/96 |
| 4,562,987 A | | 1/1986 | Leeds et al. | 248/280.1 |
| 4,625,731 A | * | 12/1986 | Quedens et al. | 600/443 |
| 4,687,167 A | | 8/1987 | Skalka et al. | 248/282 |

(Continued)

FOREIGN PATENT DOCUMENTS

| | | | |
|---|---|---|---|
| DE | G 8023053.1 | 8/1980 | 5/4 |

(Continued)

OTHER PUBLICATIONS

Advertisement for "MainFrame by Qubica USA" in Bowling Center Management Magazine dated Mar. 1999.

(Continued)

*Primary Examiner*—A. Joseph Wujciak
(74) *Attorney, Agent, or Firm*—Brinks Hofer Gilson & Lione

(57) ABSTRACT

A generally L-shaped mounting arm has one end for coupling to a bowling scoring unit and an opposite end for extending under a table top and including a mounting flange for securing the opposite end of the arm to the undersurface of the table. In one embodiment, an adapter bracket is provided and is coupled to the pedestal mount of a table itself with an extension to receive the opposite end of the mounting arm. Preferably, the scoring unit is mounted to the one end of the arm to allow its rotation for viewing at different angles and convenient access by players sitting adjacent the edge of the table from which the scoring unit extends.

12 Claims, 3 Drawing Sheets

U.S. PATENT DOCUMENTS

| | | | | | |
|---|---|---|---|---|---|
| 4,708,312 | A | | 11/1987 | Rohr | 248/280.1 |
| 4,768,744 | A | * | 9/1988 | Leeds et al. | 248/280.11 |
| 4,815,392 | A | | 3/1989 | Soot | 108/65 |
| 4,824,109 | A | | 4/1989 | Cervantes | 273/54 C |
| 4,844,387 | A | * | 7/1989 | Sorgi et al. | 108/5 |
| 4,844,388 | A | | 7/1989 | Kuba et al. | 248/1 |
| 4,854,538 | A | | 8/1989 | Von Schalscha | 248/346 |
| 5,092,552 | A | | 3/1992 | Dayton et al. | 248/280.1 |
| 5,101,354 | A | | 3/1992 | Mowers et al. | 364/410 |
| D325,868 | S | | 5/1992 | Bartok | D8/380 |
| 5,241,379 | A | | 8/1993 | Tsujita | 358/93 |
| 5,277,392 | A | | 1/1994 | Rossman et al. | 248/231.7 |
| 5,553,820 | A | | 9/1996 | Karten et al. | 248/286.1 |
| 5,618,238 | A | | 4/1997 | Kruse et al. | 473/70 |
| 5,709,360 | A | * | 1/1998 | Rosen | 248/278.1 |
| 5,719,548 | A | | 2/1998 | Stirling et al. | 340/323 B |
| 5,767,897 | A | * | 6/1998 | Howell | 348/14.07 |
| 5,788,851 | A | * | 8/1998 | Kenley et al. | 210/739 |
| 5,799,917 | A | * | 9/1998 | Li | 248/284.1 |
| 5,842,929 | A | | 12/1998 | Moody et al. | 473/70 |
| 5,845,587 | A | | 12/1998 | Ditonto | 108/50.01 |
| 5,870,485 | A | * | 2/1999 | Lundgren et al. | 381/306 |
| 5,893,607 | A | | 4/1999 | Trimnell | 248/118 |
| 5,918,840 | A | | 7/1999 | Christensen | 248/118 |
| 5,937,764 | A | | 8/1999 | Olivier | 108/20 |
| 5,970,980 | A | * | 10/1999 | Adair | 128/849 |
| 6,000,560 | A | | 12/1999 | Barkan | 211/96 |
| 6,042,064 | A | | 3/2000 | Hong | 248/118.5 |
| 6,045,179 | A | | 4/2000 | Harrison | 248/447.1 |
| 6,070,843 | A | | 6/2000 | Rosen | 248/278.1 |
| 6,076,787 | A | | 6/2000 | Troyer | 248/166 |
| 6,085,665 | A | | 7/2000 | Smith et al. | 108/24 |
| 6,131,868 | A | | 10/2000 | Welling et al. | 248/276.1 |
| 6,208,505 | B1 | | 3/2001 | Kuchta et al. | 361/683 |
| 6,367,756 | B1 | | 4/2002 | Wang | 248/278.1 |
| 6,619,603 | B1 | * | 9/2003 | Recknagel et al. | 248/200 |

FOREIGN PATENT DOCUMENTS

| | | | | | |
|---|---|---|---|---|---|
| DE | 004111422 | A | | 10/1992 | |
| FR | 2712373 | A3 | * | 5/1995 | |
| GB | 2235824 | A | * | 3/1991 | |
| JP | 6-141316 | | | 6/1994 | 7/15 |
| JP | 10-155967 | | | 6/1998 | 5/4 |
| WO | 97/15213 | | | 5/1997 | |

OTHER PUBLICATIONS

Product Data Sheet regarding "The Maestro Console by Mendes".

"Brunswick's Complaint and Jury Demand" with exhibits A and B, *Brunswick Bowling and Billiards Corporation v. Qubica USA, Inc.*, United States District Court, Northern District of Illinois, Eastern Division, Case No. 05C 3603, Judge Lindberg, 25 pages, Jun. 20, 2005.

"Defendant Qubica USA, Inc.'s Answer and Affirmative Defenses to Complaint," *Brunswick Bowling and Billiards Corporation v. Qubica USA, Inc.*, United States District Court, Northern District of Illinois, Eastern Division, Case No. 05C 3603, Judge Lindberg, 9 pages, Aug. 5, 2005.

"Response to Plaintiff's First Set of Interrogatories to Defendant," *Brunswick Bowling and Billiards Corporation v. Qubica USA, Inc.*, United States District Court, Middle District of Florida, Ft. Myers Division, Case No. 2:05-cv-510-FtM-29SPC, Judge Covington, 10 pages, Dec. 19, 2005.

"Qubica USA Purchase Order & Security Agreement," 1 page, dated Mar. 3, 1999.

Invoice, 1 page, dated Apr. 29, 1999.

Invoice, 1 page, dated Mar. 29, 1999.

"Qubica Quest 2000—Hercules Player Consoles," 1 page, undated.

"Q-USA News," 1 page, Mar. 2001.

* cited by examiner

TABLE-MOUNTED BOWLING SCORING UNIT

This application is a continuation of U.S. application Ser. No. 09/330,955 filed Jun. 11, 1999 entitled TABLE-MOUNTED BOWLING SCORING UNIT, now U.S. Pat. No. 6,619,603, hereby incorporated by reference in its entirety.

BACKGROUND OF THE INVENTION

The present invention relates to a bowling scoring unit and a mounting system for attaching the scoring unit to the undersurface of a table.

Modern bowling lane establishments include scoring systems which provide a variety of information and interactive communications between each of the players, a central station and facilities within the bowling establishment, such as restaurants, lounges and the like. There are several types of bowling scoring units in use including pedestal-mounted scoring units which operate in connection with overhead monitors for the entry of names, scores, and providing an interface between the player and the central station or other facilities within the bowling establishment. Such pedestal-mounted units may include a variety of features and are typically located immediately adjacent the ball return for each pair of lanes. Other scoring systems employ a free-standing monitor and control which eliminates the need for overhead monitors. Such systems display scores and other information and, like the pedestal-mounted scoring units, are mounted in a housing which includes a keyboard, monitor, intercom system and the like. U.S. Pat. No. 5,719,548 is representative of such a system which provides individual game information and may or may not be used with additional overhead displays.

Although these systems provide the owner of the bowling establishment with a variety of scoring and monitoring devices for the convenience of the bowlers and a variety of different priced systems, they occupy valuable space at the end of each lane which typically includes a seating area with a table for the convenience of the players while relaxing, eating and socializing. Typically, the table and seating areas behind the bowling lanes are compact, providing tables which will accommodate up to four players in the immediate vicinity of the lanes, although additional seating and table spaces are frequently available behind this area. Thus, the tables in the immediate vicinity of the bowling lanes and which are employed by the bowlers are relatively small to accommodate only their immediate needs. The free-standing and pedestal-mounted scoring units and displays, however, must be navigated around when moving from the seating area to the bowling lanes and, thus, not only occupy valuable floor space but also provide somewhat of an obstacle to the players.

SUMMARY OF THE INVENTION

The scoring system of the present invention provides a new opportunity for owners of the bowling establishment to provide flexible scoring units which do not occupy valuable table or floor space adjacent bowling lanes but rather provide a scoring unit and/or monitor/scoring unit with a mounting system allowing the unit to be mounted adjacent one end of the table and coupled to the table undersurface. Such a system, therefore, occupies no table or floor space, thereby freeing the area for an improved traffic pattern and does not interfere with the use of the table for other purposes.

Systems embodying the present invention comprise a bowling scoring unit having a housing with a generally L-shaped mounting arm with the end of the arm remote from the housing for extending under a table top and including a mounting flange for securing the end of the arm to the undersurface of the table. In one embodiment of the invention, an adapter bracket is provided for coupling to the pedestal mount of a table itself with an extension coupled to receive the flange of the mounting arm. The scoring unit may include alphanumerical keypads and an intercom system and/or may be of the type which includes a monitor with a touch screen for calling up different menus. Such units allow the player to interact with the central station and/or other facilities of the establishment. Preferably, the housing is mounted to the arm to allow its rotation for viewing at different angles and to provide convenient access by players sitting adjacent the edge of the table from which the scoring unit extends.

These and other features, objects and advantages of the present invention will become apparent upon reading the following description thereof together with reference to the accompanying drawings.

DETAILED DESCRIPTION OF THE PREFERRED EMBODIMENTS

Figure 1:
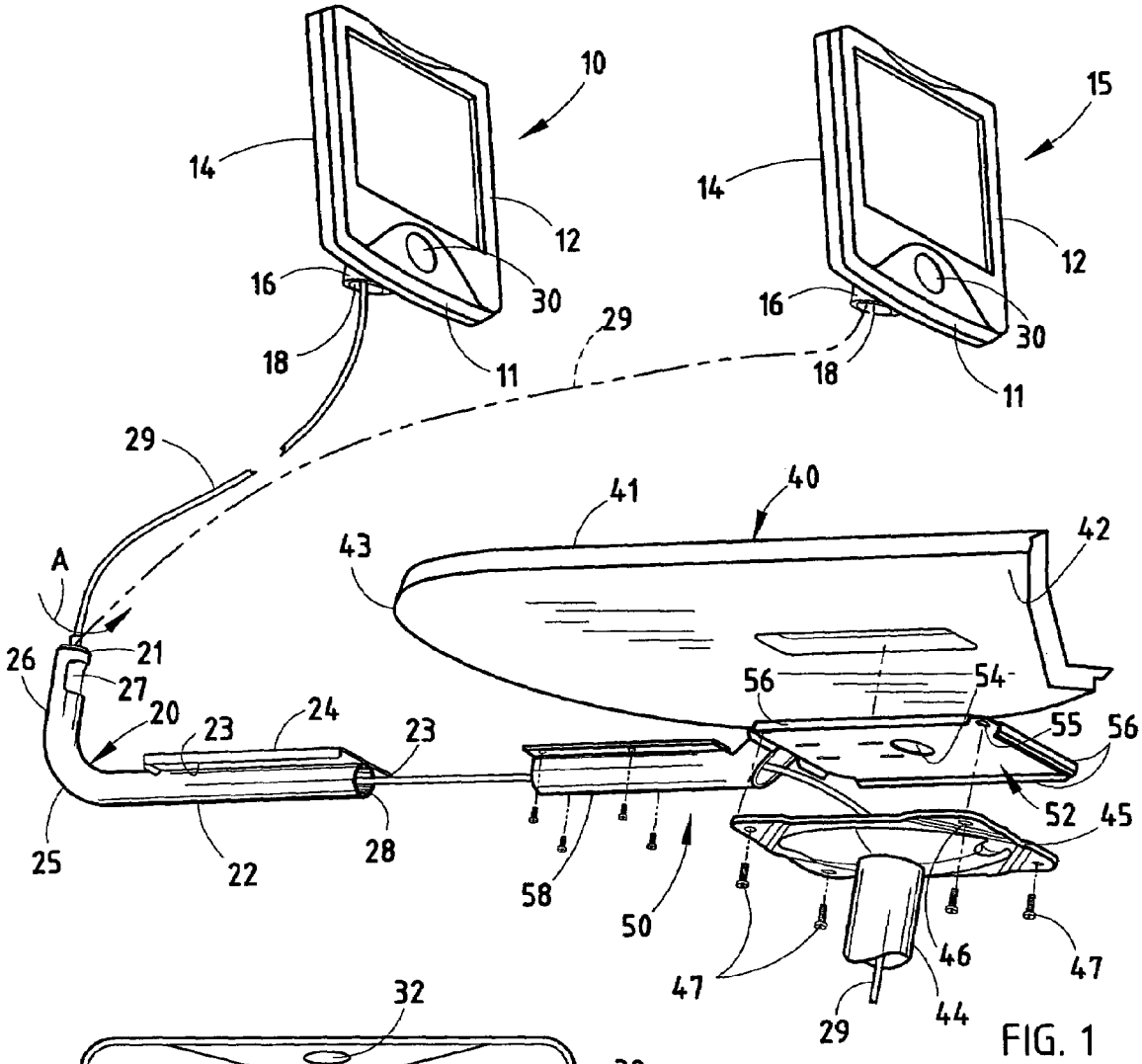
FIG. 1 is an exploded fragmentary perspective view showing a pair of different types of bowling scoring units which can employ the mounting system of the present invention.

Referring initially to FIG. 1, there is shown a first bowling scoring unit 10 and an alternative bowling scoring unit 15 with scoring unit 15 including a monitor and touch screen. Both bowling scoring units provide alpha-numeric keyboards, intercoms and control switches or keys which allow the player to select a variety of features such as different game options as well as communicate with both a central station or other facilities within the establishment, enter names, enter and view scores and the like.

Figure 5:
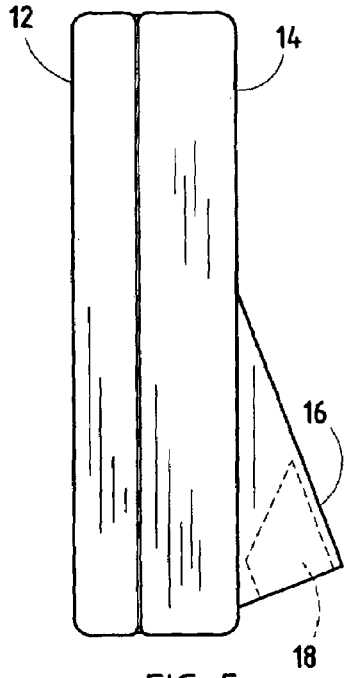
FIG. 5 is a right-side elevational view of a housing which can be employed for either of the scoring units shown in FIG. 1.

Common to both of scoring units 10 and 15 is a housing having a front wall 12 and a rear wall 14, each integrally molded of a suitable polymeric material and snap-fitted or otherwise fastened together for housing the electrical components. The rear housing 14 includes, as best seen in FIGS. 1 and 5, a tangentially extending extension 16 having an open cylindrical socket 18 at the bottom thereof for receiving one end 21 of a generally L-shaped mounting arm 20. Arm 20 has a horizontally extending section 22 with a horizontally extending mounting plate or flange 24 attached to the upper side thereof for attachment to the under surface 42 of a table 40. Table 40 can be a pedestal-type table which is mounted to the floor by a pedestal 44, as described in greater detail below, and can be generally of the shape of the tables shown in U.S. Pat. No. 5,618,238.

The section 26 of arm 20 proximate the scoring unit 10 or 15 extends vertically from the horizontally extending section 22 and is integrally joined thereto by a 90° elbow 25 with end 21 of arm 20 being positioned above the upper surface 41 of table 40 a distance such that the lower edge 11 of either of the scoring units 10 or 15 are above the top surface 41 of table 40 a distance for conveniently positioning the scoring unit for access by someone with their forearms supported on the table top. Arm section 26 includes an arcuate slot 27 into which a keeper pin (not shown) extends from the tangentially extending collar 16 of either of the scoring units 10 or 15 to permit limited arcuate motion of either of the scoring units around the longitudinal axis of the vertically extending section 26 of arm 20 in a direction indicated by arrow A in FIG. 1 such that the monitor can be rotated from side to side for viewing by players sitting on either side of the table.

Mounting plate 24 includes a plurality of apertures 31 therein (FIG. 6) for securing arm 20 in a cantilevered fashion with the distal end 28 remote from end 21 located under the table and positioned such that the vertically extending section 26 of arm 20 clears the edge 43 of table 40. Thus, arm 20 mounts to table 40 in a cantilevered fashion to support a scoring unit 10 or 15 adjacent an edge of the table and above the top surface of the table such that the top surface remains free for other use, as does the floor space below and around the table.

Figure 6:
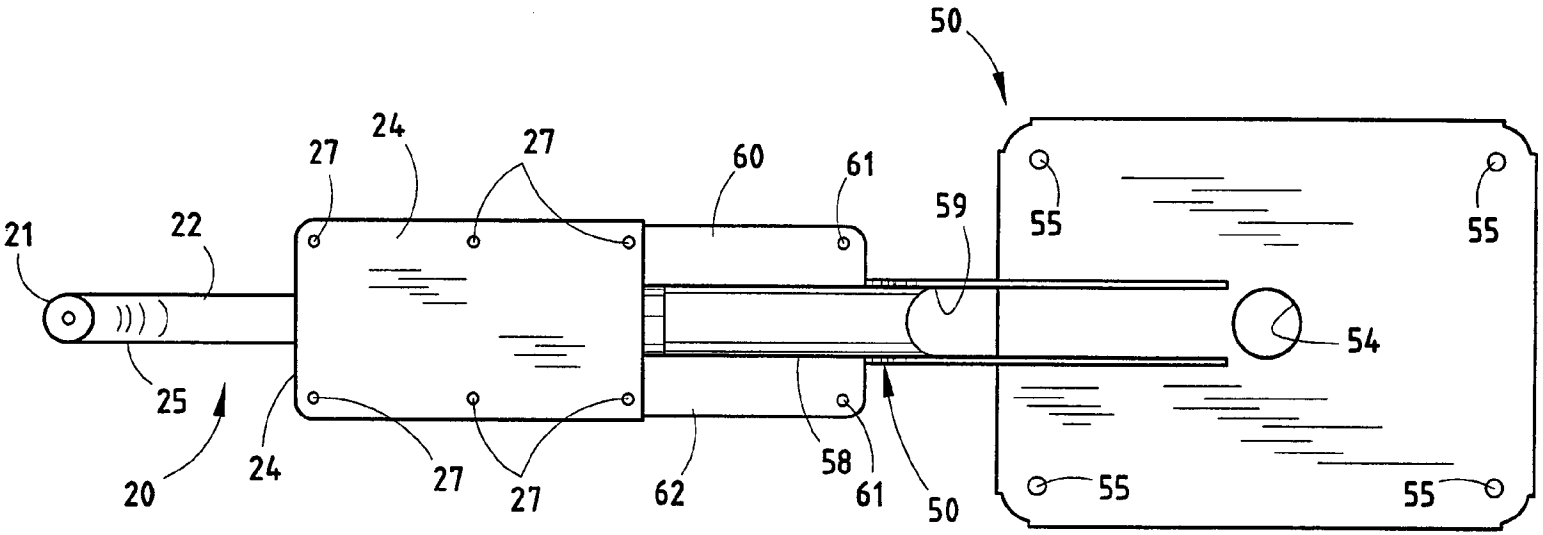
FIG. 6 is a top plan view of the mounting arm and an adapter bracket seen also in FIG. 1.
Figure 7:
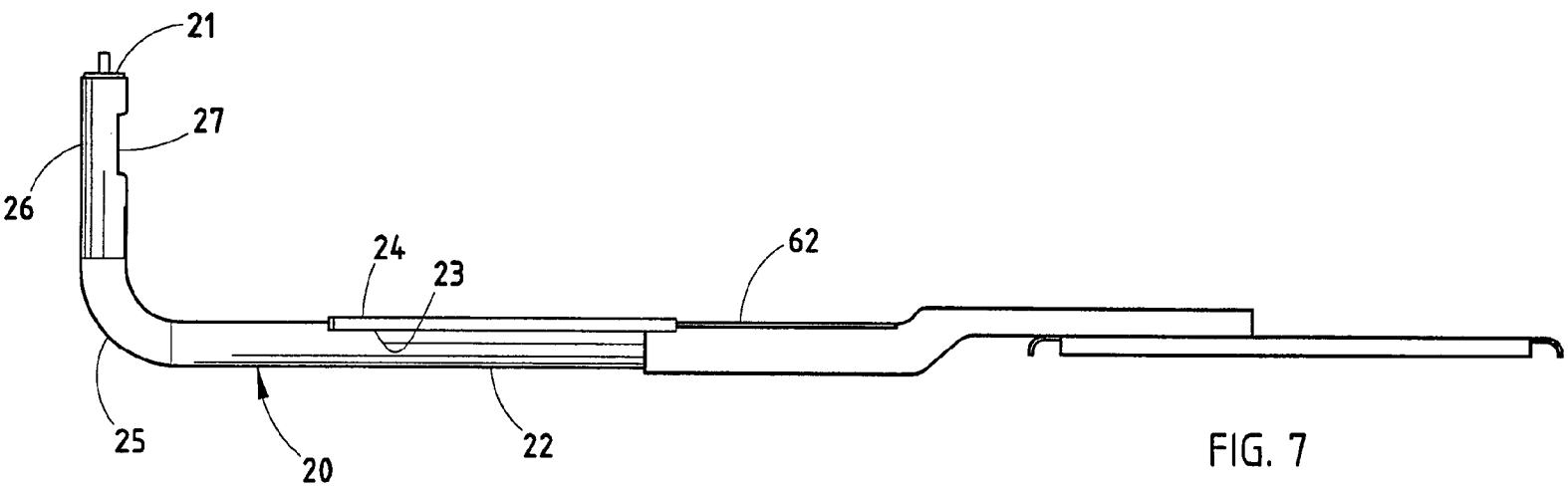
FIG. 7 is a front elevational view of the structure shown in FIG. 6.

Arm 20 is a hollow cylindrical metal tube with a suitable exterior finish. The tube-like structure allows an electrical conductor 29 to extend therethrough and be coupled to the scoring unit 10 or 15 and extended to couple to the central station of the establishment for communicating between the central station, the pin setting system and other facilities within the establishment. Before describing a preferred embodiment of the invention which incorporates an intermediate adaptive mounting bracket 50, as shown in FIGS. 1, 6 and 7, a more detailed description of the scoring units 10 and 15 briefly follow.

Figure 2:
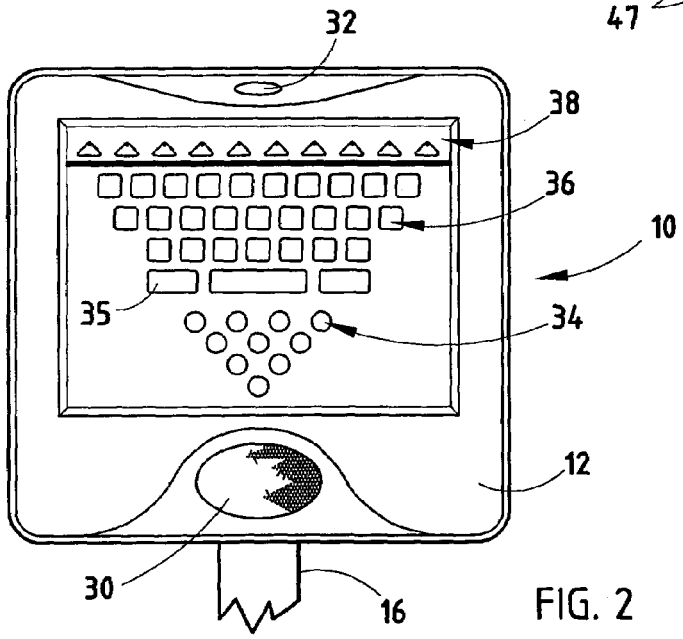
FIG. 2 is an enlarged perspective view of one of the scoring units shown in FIG. 1.
Figure 3:
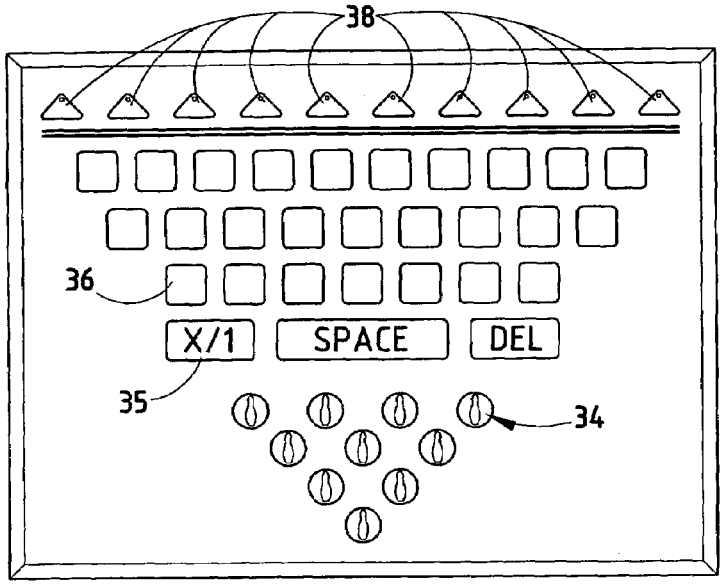
FIG. 3 is an enlarged view of the control panel section of the scoring unit shown in FIG. 2.

Scoring unit 10 is seen in FIGS. 2 and 3 and comprises a generally rectangular housing with the front wall 12 including a speaker 30 mounted to the lower edge thereof and a microphone 32 mounted to the upper edge. Above the speaker there is mounted a numerical entry keypad 34 in the configuration of the bowling pin set up and above the numerical entry keypad 34 is an alpha keypad 36 in a conventional arrangement for the entry of names or other information by the players. A strike/spare key 35 and other conventional keys are positioned below the alpha keyboard 36. Above the keyboard are a plurality of entry keys 38 for the entry of select items such as game type, communications with the central control, communications with an eating facility within the establishment and the like. The layout of the control keys for the scoring unit 10 is shown in greater detail in FIG. 3.

Figure 4:
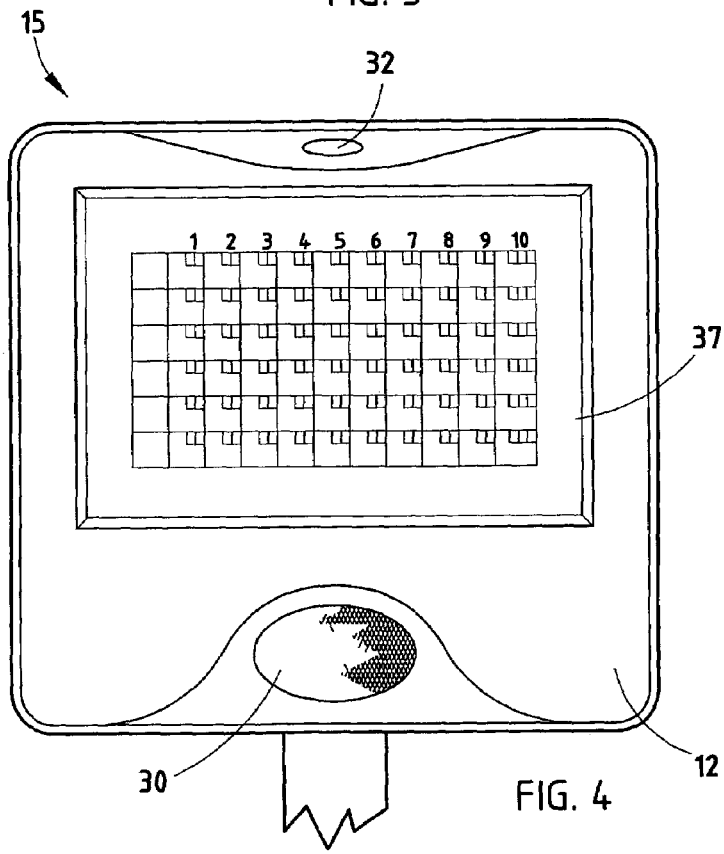
FIG. 4 is an enlarged front elevational view of the other scoring unit shown in FIG. 1.

The alternate scoring unit 15 is shown in FIG. 4 and also includes a speaker 30 on the lower end of front wall 12 and a microphone 32 along the upper edge of the wall. The central area of scorer 15 comprises a touch screen monitor 37 which, as seen in FIG. 4, includes a bowling score sheet when displaying the bowling scores and, upon activation of the touch screen, different menus are displayed for entry of bowlers names, communications with the central control, ordering of food and drink, and the like in a conventional manner, such as the system disclosed in U.S. Pat. No. 5,719,548. With scoring unit 10, an overhead monitor is mounted within the establishment remote from table 40, while scoring unit 15 is designed to be used with or without such monitors. With both systems, a bowling scoring unit is provided with a coupling, such as arm 20, which positions the scoring unit adjacent an edge 43 of the table 40 above the top surface 41 of the table in a convenient location for use by the players without occupying either the top surface of the table or floor space. In a preferred embodiment of the invention, the mounting arm 20 is integrated to the table-mounting pedestal 44 by an adaptive bracket 50 now described.

Bracket 50 includes a generally horizontally extending mounting plate 52 having a central opening 54 therein and lips 56 extending downwardly from three edges thereof which overlie a horizontally extending mounting flange 45 secured to pedestal 44 for conventionally mounting the table 40 to the floor of the facility. Thus, the shape of mounting plate 52 associated with adaptive bracket 50 is such that it overlies and extends between the pedestal mounting flange 45 and the lower surface 42 of table 40 with mounting apertures 55 aligned with apertures 46 of flange 45 such that fastening screws 47 can extend through flange 45 associated with the table pedestal 44 and mounting plate 52 associated with adaptive bracket 50. Integrally extending and formed with plate 52 is a semi-cylindrical end collar 58 defining an open upper trough 59 (FIG. 6) for telescopically receiving horizontally extending section 22 of mounting arm 20. The mounting plate 24 of arm 20 overlies horizontally extending flanges 60, 62 (FIG. 6) integrally formed with and extending from the opposite sides of collar 58. The horizontally extending mounting plate 24 of arm 20 may include downwardly extending lips 23 (FIG. 7) to stabilize the interconnection of arm 20 onto collar 58 and flanges 60, 62. Flanges 60, 62 include apertures 61 which align with apertures 31 in plate 24 and permit the arm 20 to be mounted at various locations along the longitudinal length of extension 58 or overlie the extension depending upon the size of the table. Conductor 29 extends through the central opening 54 of mounting plate 52 and downwardly through the open cylindrical tubular pedestal 44 to the central control station for inter-coupling either scoring unit 10 or 15 to the central control. By providing the adaptive bracket 50, arm 20 can be adjustably mounted and provide a more secure inter-coupling of the arm to the lower surface of the table. Although this feature is a preferred structure for pedestal-type tables, arm 20 as described above can be used independently of such an adaptive bracket.

Thus, as seen with the system of the present invention, a scoring unit is provided which occupies no table space, no floor space, and provides a scoring unit which can have flexible features depending upon the establishment design to provide players with a conveniently located, readily accessible scoring unit for communications with the central control and other facilities within the establishment. It will become apparent to those skilled in the art that various modifications to the preferred embodiments of the invention as described herein can be made without departing from the spirit or scope of the invention as defined by the appended claims.

The invention claimed is:

1. A bowling scorer adapted for mounting on a table of the type having a top with an upper surface, a lower surface, an outer marginal edge and a support pedestal with an upper mounting flange positioned adjacent the lower surface of the top, said scorer comprising:

a rigid mounting arm having a generally L-shaped side elevational configuration defining a horizontal portion with an outer end, and a vertical portion with an upper end;

a scorer supported on the vertical portion of said mounting arm adjacent the upper end thereof;

a mounting plate supported on the horizontal portion of said mounting arm adjacent the outer end thereof, and adapted for connection with the top at a position which locates said scorer at a predetermined position adjacent to the marginal edge of the top and above the upper surface thereof to facilitate viewing by a bowler; said mounting plate including at least one vertically oriented fastener aperture therethrough positioned for vertical alignment with a mating fastener aperture in the upper mounting flange of the support pedestal; and at least one fastener received through said fastener aperture in said mounting plate, whereby said fastener extends through the vertically aligned apertures in the upper mounting flange of the support pedestal and the mounting plate of said mounting arm, and is anchored in the top to positively capture said mounting plate between the top and the support pedestal, and thereby securely retain said scorer in said predetermined position;

said scorer is pivotally supported on the upper end of the vertical portion of said mounting arm for rotation about a generally vertical axis to facilitate viewing from opposite sides of the table;

said scorer includes a front wall oriented at a predetermined angle to said generally vertical axis;

said front wall includes a generally flat display screen;

said front wall further includes a speaker;

said front wall further includes a touch control portion;

said scorer includes a housing with a downwardly opening socket in which the upper end of the vertical portion of said mounting arm is received to pivotally support said scorer thereon.

2. A bowling scorer as set forth in claim 1, wherein:

said mounting arm is hollow to receive wiring therethrough.

3. A bowling scorer as set forth in claim 2, wherein:

said mounting plate includes a plurality of said vertically oriented fastener apertures therein arranged in a spaced apart relationship in vertical alignment with associated fastener apertures in the upper mounting flange of the support pedestal.

4. A bowling scorer as set forth in claim 3, including:

a plurality of said fasteners received through the fastener apertures in said mounting plate.

5. A bowling scorer as set forth in claim 4, wherein:

said mounting plate has a generally rectangular plan configuration.

6. A bowling scorer as set forth in claim 5, wherein:

said horizontal portion of said mounting arm has a length that is greater than the length of the vertical portion of said mounting arm.

7. A bowling scorer as set forth in claim 6, wherein:

said mounting arm has a generally circular lateral cross-sectional shape.

8. A bowling scorer as set forth in claim 7, wherein:

at least four of said fastener apertures are arranged in a generally square configuration on said mounting plate.

9. A bowling scorer as set forth in claim 8, wherein:

said mounting plate includes an adaptive bracket portion to facilitate mounting said bowling scorer on differently sized tables.

10. A bowling scorer as set forth in claim 9, wherein:

said adaptive bracket includes a mounting plate portion disposed above the upper mounting flange of the support pedestal, a flange portion extending laterally outwardly from said mounting plate portion, and a mounting flange portion connected both with the horizontal portion of said mounting arm and said flange portion.

11. A bowling scorer adapted for mounting on a table of the type having a top with an upper surface, a lower surface, an outer marginal edge and a support pedestal with an upper mounting flange positioned adjacent the lower surface of the top, said scorer comprising:

a rigid mounting arm having a generally L-shaped side elevational configuration defining a horizontal portion with an outer end, and a vertical portion with an upper end;

a scorer supported on the vertical portion of said mounting arm adjacent the upper end thereof;

a mounting plate supported on the horizontal portion of said mounting arm adjacent the outer end thereof, and adapted for connection with the top at a position which locates said scorer at a predetermined position adjacent to the marginal edge of the top and above the upper surface thereof to facilitate viewing by a bowler; said mounting plate including at least one vertically oriented fastener aperture therethrough positioned for vertical alignment with a mating fastener aperture in the upper mounting flange of the support pedestal; and at least one fastener received through said fastener aperture in said mounting plate, whereby said fastener extends through the vertically aligned apertures in the upper mounting flange of the support pedestal and the mounting plate of said mounting arm, and is anchored in the top to positively capture said mounting plate between the top and the support pedestal, and thereby securely retain said scorer in said predetermined position;

said scorer includes a housing with a downwardly opening socket in which the upper end of the vertical portion of said mounting arm is received to pivotally support said scorer thereon.

12. A table-mounted bowling scorer, comprising:

a table having a top with an upper surface, a lower surface, an outer marginal edge and a support pedestal with an upper mounting flange positioned adjacent the lower surface of said top;

a rigid mounting arm having a generally L-shaped side elevational configuration defining a horizontal portion with an outer end, and a vertical portion with an upper end;

a scorer supported on the vertical portion of said mounting arm adjacent the upper end thereof;

a mounting plate supported on the horizontal portion of said mounting arm adjacent the outer end thereof, and adapted for connection with said top at a position which locates said scorer at a predetermined position adjacent to the marginal edge of said top and above the upper surface thereof to facilitate viewing by a bowler; said mounting plate including at least one vertically oriented fastener aperture therethrough positioned for vertical alignment with a mating fastener aperture in the upper mounting flange of said support pedestal; and at least one fastener received through said fastener aperture in said mounting plate, whereby said fastener extends through the vertically aligned apertures in the upper mounting flange of said support pedestal and the mounting plate of said mounting arm, and is anchored in said top to positively capture said mounting plate between said top and said support pedestal, and thereby securely retain said scorer in said predetermined position;

said scorer includes a housing with a downwardly opening socket in which the upper end of the vertical portion of said mounting arm is received to pivotally support said scorer thereon.

* * * * *